US008695234B2

(12) United States Patent
Wu

(10) Patent No.: US 8,695,234 B2
(45) Date of Patent: Apr. 15, 2014

(54) ANTI-SLIP SPIKE STRUCTURE

(76) Inventor: Han-Ching Wu, Taichung Hsien (TW)

( * ) Notice: Subject to any disclaimer, the term of this patent is extended or adjusted under 35 U.S.C. 154(b) by 481 days.

(21) Appl. No.: 12/978,640

(22) Filed: Dec. 27, 2010

(65) Prior Publication Data

US 2012/0159816 A1 Jun. 28, 2012

(51) Int. Cl.
*A43C 15/06* (2006.01)

(52) U.S. Cl.
USPC ..... 36/59 R; 36/67 B

(58) Field of Classification Search
USPC ..... 36/59 R, 67 B, 67 R, 59 A, 61, 67 A
See application file for complete search history.

(56) References Cited

U.S. PATENT DOCUMENTS

| | | | | | |
|---|---|---|---|---|---|
| 2,470,997 | A | * | 5/1949 | Mckenzie | 36/59 R |
| 3,010,229 | A | * | 11/1961 | Snitzer | 36/127 |
| 3,352,034 | A | * | 11/1967 | Braun | 36/67 D |
| 3,522,669 | A | * | 8/1970 | Morris | 36/67 A |
| 3,768,183 | A | * | 10/1973 | Fessenden | 36/67 R |
| 3,775,874 | A | * | 12/1973 | Bonneville | 36/67 D |
| 3,846,921 | A | * | 11/1974 | Kobayashi | 36/59 R |
| 4,466,205 | A | * | 8/1984 | Corbari | 36/134 |
| 4,715,133 | A | * | 12/1987 | Hartjes et al. | 36/127 |
| 4,899,467 | A | * | 2/1990 | Mackey | 36/59 A |
| 5,386,651 | A | * | 2/1995 | Okamoto | 36/134 |
| 5,634,283 | A | * | 6/1997 | Kastner | 36/61 |
| 8,176,660 | B2 | * | 5/2012 | Auger et al. | 36/134 |
| 2002/0029495 | A1 | * | 3/2002 | Kastner | 36/59 R |

* cited by examiner

*Primary Examiner* — Ted Kavanaugh
(74) *Attorney, Agent, or Firm* — Leong C. Lei

(57) ABSTRACT

An improved anti-slip spike structure is provided, which is used in soles of snow shoes or special anti-slip shoes. In this structure, an anti-slip spike is mainly arranged on a sole surface. An external side of a metal spike body is wrapped with a hard rubber body into a solid cylindrical rod-shaped rubber spike. Then, the solid cylindrical rod-shaped rubber spike is placed into a shaping module to be integrally formed with a rubber sole. Since the rubber spike is entirely wrapped and has a large placement plane, it is easy to position the rubber spike in a mold. In addition, when the rubber spike is pressed to be shaped, the spike does not skew or shift and is homogeneously shaped with the rubber, so that the spike is completely joined to the sole. In this way, the sole is provided with comfort and flexibility, as well as firm joining against trampling and significant anti-slip safety and practicability.

6 Claims, 2 Drawing Sheets

ANTI-SLIP SPIKE STRUCTURE

BACKGROUND OF THE INVENTION (a) Technical Field of the Invention

The present invention relates to an improved anti-slip spike structure, provides a spike structure design capable of being positioned easily in a mold and being completely and firmly joined to a sole. By wrapping a metal spike body with a hard rubber body, a cylindrical rod-shaped anti-slip rubber spike is formed to facilitate the shaping of a sole. In this way, the spike can be positioned easily in a mold, and practical firm joining as well as anti-slip safety and practicability without causing the spike to fall off can be achieved.

(b) Description of the Prior Art

There is a kind of anti-slip shoes which are used in the snowfield or used when fishing on the rock. The anti-slip shoes generally need to have a strong and significant land-grip capability. A conventional spike is generally designed with a spike head locked with a spike base. The conventional spike is arranged with a combination formed by wrapping a metal locking member. The shoes have concavo-convex sole surfaces for achieving relative auxiliary effects of interlock and land-grip in the snowfield. However, when trampling on a hard rock surface or a smooth ground surface, the shoes fail to achieve a significant auxiliary effect of land-grip due to the convex granular appearance of the spike surface, thus greatly decreasing the anti-slip efficiency. Therefore, a spike design is developed, wherein the metal spike directly contacts the ground. The spike design includes an approximately T-shaped spike body, and a hard thin rod protruding from the bottom. Accordingly, the spike design can significantly clamp and grip the land, thereby achieving the anti-slip effect. When shaped, the spike body is placed directly into a shaping module of a sole to be integrally formed with the sole. This positioning operation of press forming is the most inconvenient and difficult to overcome for manufacturers. In particular, when a rubber material is pressed to flow, the pressure thereof is extremely large. This will cause the spike to irregularly skew due to the uneven distribution of load, because the spike with a partial insertion combination of the T-shaped bottom insert-and-join rod head is inserted in a wide overhead way of the T-shaped end sheet. Furthermore, the spike head of the protruding thin rod of the spike cannot be arranged to protrude essentially perpendicular to the sole surface, which causes an actually unsmooth contact with the ground. What disturbs the manufacturers and users more is the selection of a sole rubber material. Since requirements for actual wearing comfort need to be taken into account, a soft material is generally selected. However, because the material is soft and flexible and an auxiliary positioning convex ring is arranged to protrude from the shaping module, an open concave spacing ring groove is formed on a bottom edge of the spike rod wrapped by rubber. Thus, the wrapped portion of the spike rod is relatively shortened. Accordingly, because the rubber wrapping the spike body is too soft and the length of the wrapped portion is insufficient, the shaped metal spike body is likely to fall out of the spike under an excessive instant pressure when trampling heavily or used for land-grip and anti-slip purposes on a special rock surface. The falloff of the spike body greatly reduces the overall anti-slip effect. In order to improve the imperfect joint of this actual wrapping, current manufacturers typically increase the common rubber hardness of the sole directly to a higher level, thus decreasing the wearing comfort of the shoes. Therefore, the shoes are difficult to bend, and the uncomfortable inflexibility thereof can be imagined easily.

SUMMARY OF THE INVENTION

In view of the existing anti-slip sole spike structure design, which causes many problems such as anti-slip safety during actual anti-slip use and inconvenient placement in a mold during shaping, the inventor of the present invention finally develops an improved anti-slip spike structure after elaborative research and improvement. In the improved anti-slip spike structure, a metal spike body is wrapped by a hard rubber body in advance, so as to form a hard cylindrical rod-shaped rubber spike. The spike is evenly placed and positioned and homogeneously joined to rubber according to a large ring diameter of the spike, so that the whole spike is completely joined to the sole, thereby effectively improving some defects in actual use such as infirm joining and inconvenient placement in a mold.

The present invention mainly aims to provide a spike structure, wherein the spike can be easily placed and positioned when a sole is shaped. By wrapping an outer edge of the spike with a rubber body, the spike can be integrally formed with the sole without separation. In addition, by preforming the spike with a hard rubber, the material of the sole can be selected to be soft and flexible, thereby achieving a wearing comfort without causing the spike to fall off. In this way, it is ensured that the sole can achieve the effects and purposes of anti-slip safety in use and practicability.

The spike design of the present invention further achieves the purpose that the sole is made to be beautiful with different colors by mixing colors when the spike is wrapped by the hard rubber body.

DETAILED DESCRIPTION OF THE PREFERRED EMBODIMENTS

Figure 1:
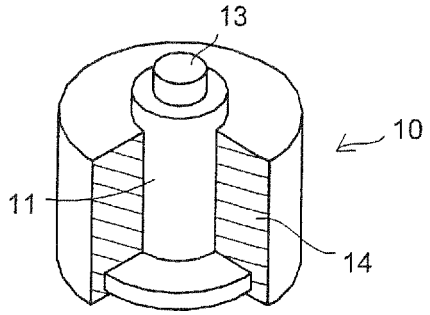
FIG. 1 is a sectional reference view of a three-dimensional appearance portion of a rubber spike of the present invention.
Figure 2:
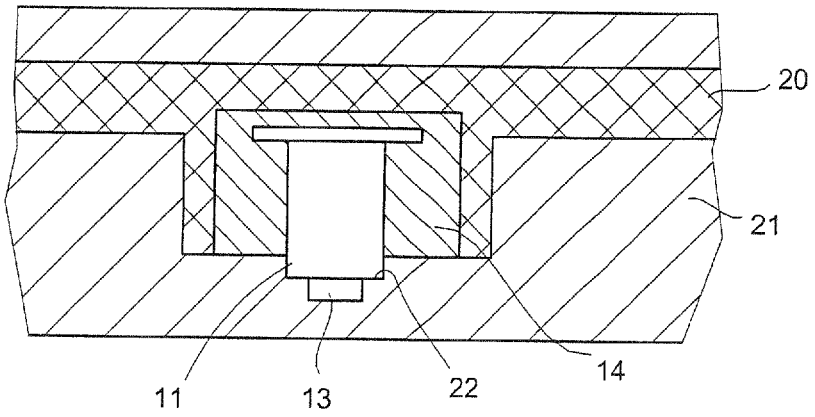
FIG. 2 is a structural reference view of a rubber spike of the present invention shaped with a sole.
Figure 3:
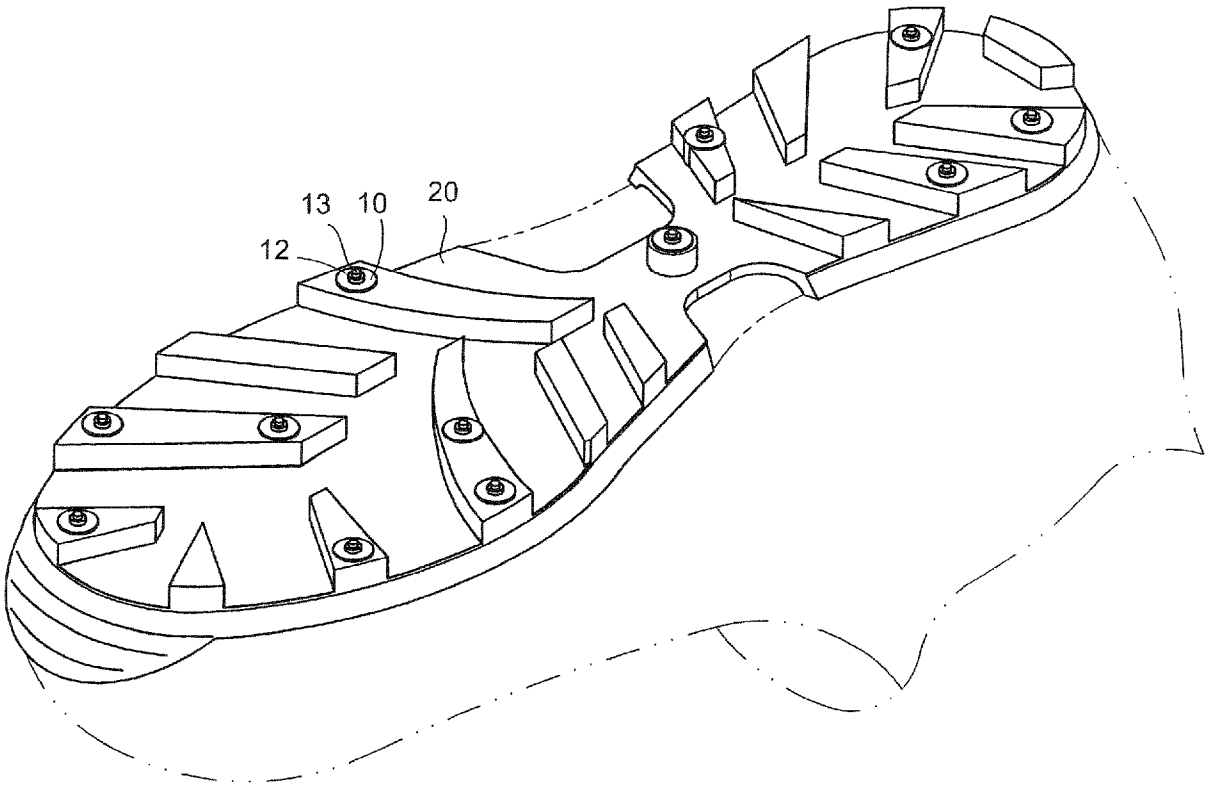
FIG. 3 is a schematic reference view of an appearance of a finished anti-slip sole of the present invention.

The present invention mainly provides an improved anti-slip spike structure used in soles of snow shoes with a special anti-slip purpose or anti-slip fishing shoes. As shown in FIGS. 1-3, an improved design of a whole anti-slip rubber spike (10) includes a T-shaped spike body (11) made from a metal material. The T-shaped spike body (11) has a similar structure design with a spike used in the existing shoes, and it can be replaced by currently available goods. The whole spike is formed by punching the metal material into the T-shaped spike body (11). An extending thin rod (13) is inserted and arranged to protrude at a center of an end surface of a bottom spike head (12), thus forming a spike tip-shaped design. In addition to roughening an outer edge of the spike body (11) in advance, the spike body can be roughened easily by being soaked in a chemical and then cleared or by a rough surface of a machine, so that the surface of the spike body can fully contact the rubber and join with the rubber. The spike tip end is inserted and placed into a preformed mold, and the outer edge of the whole spike body (11) is wrapped with a hard rubber material having a hardness value of up to 65-80 A, thereby forming a cylindrical rod-shaped rubber spike (10). That is, the spike is arranged into a thick and hard entity, so as to form a force bearing structure against trampling on the whole sole surface. The wrapping thickness of the rubber body (14) can be designed to be 2-4 times the ring diameter of the spike rod of the spike body (11), so as to completely wrap the T-shaped top end sheet. Thus, an external ring of the metal spike body (11) is covered with the rubber body (14) having an appropriate thickness, and only a spike head (12) is left to protrude with an appropriate length. Preferably, the spike head (12) generally protrudes with an end edge of about 1-3 mm, so as to form a metal spike head. The thin rod (13) extending and protruding along the end surface of the spike head (12) forms an interlocking tip end of the metal spike, which can achieve an auxiliary land-grip and interlock effect and a substantial anti-slip effect when trampling on the snow-field or used on a special rock surface. In this way, the improved structure of the anti-slip rubber spike (10) used in the sole (20) of the present invention is formed. The rubber spike (10) of the present invention is directly inserted and placed into a shaping module of the sole (20). Through a step-shaped concave positioning groove (22) on a surface of a formwork (21), the spike head (12) is easily and completely inserted and joined, so as to not only ensure the perpendicular positioning of the inserting and joining, but also achieve the stable and significant effect of the inserting and joining during assembling particularly through a wide design of the ring diameter of the end surface of the rubber body (14). Moreover, it is ensured that the spike structure will not skew or shift when it is pressed to be shaped with the sole (20). Therefore, the yield rate of the anti-slip product is improved and ensured. Further, because of the hardness property of the rubber body (14) wrapping the spike, the spike body (11) joins firmly without falling out of the spike. Since the rubber body (14) and the sole (20) are both made of a rubber material, the effect of a firm joint can be achieved, and thus the spike indeed plays its anti-slip effect, thereby achieving safety and practicability of the anti-slip shoes.

In the structure of the anti-slip rubber spike (10) of the present invention, a hard rubber material is used as the rubber body (14) to wrap the outer edge of the whole T-shaped spike body (11) in a molding form, and only the very short spike head (12) and the tip end of the thin rod (13) inserted and arranged at the bottom are left to slightly protrude outside. Through this slightly protruding spike head (12) and the wide ring diameter design of the wrapping rubber body (14), the spike can be easily inserted and placed into the positioning groove (22) preset on the formwork (21) when the sole (20) is shaped in a mold. In addition to the end surface of the rubber body (14) with a large ring diameter which facilitates the accurate operation of firm insertion and placement, the contacting and placing end surface of the spike is very large, and therefore the spike will not skew or shift when pressed to be shaped with the sole (20), so as to achieve the stable and significant effect of the anti-slip structure of the sole (20). In the structure of the rubber spike (10) of the present invention, the wrapping rubber body (14) is colored separately and shaped when the rubber spike (10) is shaped depending on the coloring requirements of the sole (20), thereby facilitating an alternate design of specific color separation for matching with the sole (20), so as to achieve the beautification result of the appearance of the sole (20).

In the structure design of the anti-slip rubber spike (10) of the present invention, the spike actually has another more positive and useful property. That is, during the operation of shaping the sole (20), a common material of the sole (20) typically needs to be provided with a great hardness to prevent the spike body from falling out of the spike in the conventional art. A defect caused by the above configuration is that the sole (20) is uncomfortable to wear due to the hardness. Furthermore, because of imperfect fluidity of the material, the situation in which the spike skews is difficult to overcome. In the present invention, the metal spike body (11) is wrapped by the hard rubber body (14) to form in the safe rubber spike (10). Through the hard rubber spike (10), the spike body (11) is effectively protected when placed into the mold. The force bearing body on the surface of the whole sole (20) is significantly formed after the structure of the hard rubber spike (10) is integrally formed with the sole (20). Therefore, the shaping material of the sole (20) can be selected to have a hardness value of about 50 A. Through the compatible and firm joining of the rubber material of the outer edge of the rubber spike (10), the rubber spike (10) can be integrally formed with the sole (20). The sole (20) can also have the comfortable and flexible use property, so that the shoes are safe, anti-slip and comfortable for wearing. As for the anti-slip shaping structure design of the shoes, the anti-slip improvement and the shaping design of the rubber spike (10) of the present invention have improved anti-slip, stable, practical, convenient and safe properties, which are indeed an improved design of the anti-slip spike of the sole. As for the actual anti-slip safety as well as actual economical and convenient effects, the spike structure is indeed an innovative design of the anti-slip spike structure. The convenient and safe use effects of the spike structure is indeed an innovative design of the anti-slip shoes of a similar type.

I claim:

1. An improved anti-slip spike structure, comprising a T-shaped spike body, which has a T-shaped end and an opposite spike head and is made of a metal material in such a way that a thin rod protrudes from the spike head of the spike body; wherein the spike body has an external circumferential surface that is circumferentially wrapped with a unitary rubber body having a hardness value of 65-80 A, the T-shaped end of the spike body being also enclosed by the rubber body so as to form a cylindrical rod-shaped rubber-covered spike, with the spike head of the spike body from which the thin rod protrudes protruding out of an end surface of the rubber body, the cylindrical rod-shaped rubber-covered spike being combinable with a sole that is made of a rubber material having a hardness less than the rubber body in such a way that the rubber body that wraps the spike body and encloses the T-shaped end is embedded in the rubber material of the sole with the thin rod of the spike body extending outside the sole.

2. The improved anti-slip spike structure of claim 1, wherein the rubber body that wraps the spike body has a thickness that is set to be two to four times of a diameter of the spike body.

3. The improved anti-slip spike structure of claim 1, wherein the spike head of the spike body protrudes out of the end surface of the rubber-body by a distance in the range of 1-3 mm.

4. The improved anti-slip spike structure of claim 1, wherein the rubber body is manufactured with different colors.

5. The improved anti-slip spike structure of claim 1, wherein the rubber material that makes the sole has a rubber hardness of about 50 A.

6. The improved anti-slip spike structure of claim 1, wherein the external circumferential surface of the spike body that is pre-roughened.

* * * * *